US008113824B2

(12) United States Patent
Sarv et al.

(10) Patent No.: US 8,113,824 B2
(45) Date of Patent: Feb. 14, 2012

(54) LARGE DIAMETER MID-ZONE AIR SEPARATION CONE FOR EXPANDING IRZ

(75) Inventors: Hamid Sarv, Canton, OH (US); Albert D. LaRue, Uniontown, OH (US); William J. Kahle, Canal Fulton, OH (US); Alan N. Sayre, North Canton, OH (US); Daniel R. Rowley, Alliance, OH (US)

(73) Assignee: Babcock & Wilcox Power Generation Group, Inc.

( * ) Notice: Subject to any disclaimer, the term of this patent is extended or adjusted under 35 U.S.C. 154(b) by 41 days.

(21) Appl. No.: 11/444,779

(22) Filed: Jun. 1, 2006

(65) Prior Publication Data

US 2007/0281265 A1 Dec. 6, 2007

(51) Int. Cl.
*F23M 9/00* (2006.01)

(52) U.S. Cl. ..... 431/182; 431/184; 431/185; 431/187; 431/285; 431/354; 110/261; 110/262; 110/264; 110/347; 239/415; 239/427

(58) Field of Classification Search ..... 431/182, 431/285, 184, 187, 189, 354, 8, 9, 115, 2, 431/181, 186, 188; 110/261, 263, 264, 265, 110/347, 262, 345, 346; 239/427, 415, 424, 239/404

See application file for complete search history.

(56) References Cited

U.S. PATENT DOCUMENTS

| | | | | | |
|---|---|---|---|---|---|
| 4,545,307 | A * | 10/1985 | Morita et al. | ..... | 110/264 |
| 4,836,772 | A * | 6/1989 | LaRue | ..... | 431/285 |
| 5,199,355 | A * | 4/1993 | Larue | ..... | 110/261 |
| 5,263,426 | A * | 11/1993 | Morita et al. | ..... | 110/265 |
| 5,651,320 | A * | 7/1997 | Leisse et al. | ..... | 110/262 |
| 5,697,306 | A * | 12/1997 | LaRue et al. | ..... | 110/261 |
| 5,937,770 | A * | 8/1999 | Kobayashi et al. | ..... | 110/263 |
| 6,024,030 | A * | 2/2000 | Okamoto et al. | ..... | 110/261 |
| 6,145,450 | A * | 11/2000 | Vatsky | ..... | 110/265 |
| 7,028,622 | B2 * | 4/2006 | Taylor | ..... | 110/265 |

* cited by examiner

*Primary Examiner* — Steven B McAllister
*Assistant Examiner* — Avinash Savani
(74) *Attorney, Agent, or Firm* — Michael J. Seymour; Eric Marich

(57) ABSTRACT

A large diameter mid-zone air separation cone is provided for decreasing NOx during burner operation by expanding the internal recirculation zone (IRZ) at the burner exit. The mid-zone air separation cone has a short cylindrical leading edge that fits in the outer air zone of a burner. The mid-zone air separation cone splits the outer air zone secondary air flow into two equal or unequal streams depending on the position of the air separation cone with respect to the outer air zone, and deflects a portion of the secondary air flow radially outward. Since the radial position of the air separation cone is farther from the burner centerline, the IRZ size is expanded and NOx emissions are minimized.

12 Claims, 6 Drawing Sheets

LARGE DIAMETER MID-ZONE AIR SEPARATION CONE FOR EXPANDING IRZ

FIELD AND BACKGROUND OF THE INVENTION

The present invention relates generally to the field of fuel burners and in particular to a new and useful air separation cone for expanding the internal recirculation zone near the exit of one or more air zones surrounding a fuel delivery nozzle.

Low-NOx fossil fuel burners operate on the principle of controlled separation and mixing of fuel and oxidizer for minimizing the oxidation of fuel-bound nitrogen and nitrogen in the air to NOx (i.e., NO+NO2). Use of overfire air in conjunction with fuel-rich combustion is referred to as external (or air) staging. Internal staging involves the creation of fuel-rich and fuel-lean combustion zones within the burner flame. With proper design, fuel-air mixing and swirl patterns can be optimized to create a reverse flow region or "internal recirculation zone" (IRZ) near the burner exit for recycling heat and combustion products including NOx from fuel-lean regions into fuel-rich zones to sustain ignition, maintain flame stability, and convert NOx to N2. Both internal and external staging are often necessary for maximum NOx reduction. Flames with large, high temperature, sub-stoichiometric (oxygen-deficient) IRZ's generally produce very low NOx levels since such conditions are conducive for NOx destruction. Low-NOx burner designs produce the IRZ by imparting swirl on the air and/or fuel streams as well as flow deflecting devices such as flame holders and air separation cones.

FIG. 1 shows a low-NOx pulverized coal fired burner 900 having a conventional air separation cone. Primary air and pulverized coal 902 are blown into an inlet and pass through a burner elbow 904. The pulverized coal concentrates along the outer radius at the elbow exit. The pulverized coal enters the inlet end of a fuel nozzle or tubular burner nozzle 906, and encounters a deflector 908 which redirects the coal stream into a conical diffuser 912, which disperses the majority of the pulverized coal particles entrained in the primary air to a location near the inside surface of the tubular burner nozzle 906, leaving the central portion of the nozzle 906 relatively free of pulverized coal particles.

Secondary air 910, or the majority of combustion air, is delivered to inner and outer secondary air zones 914 and 916 from the burner windbox. Swirl can be imparted into the zones 914 and 916 via adjustable angle spin vanes 922 in the inner air zone 914 and both fixed spin vanes 920 and adjustable angle spin vanes 922 in the outer air zone 916. The inner and outer secondary air zones 914 and 916 are formed by concentrically surrounding walls. The inner air zone 914 concentrically surrounds the tubular burner nozzle 906 and the outer air zone 916 concentrically surrounds the inner air zone 914.

An air separation cone 924, concentrically surrounding the end of the tubular burner nozzle 906, helps channel the secondary air 910 leaving the inner and outer air zones 914 and 916. A flame stabilizer 926 and a slide damper 928 control the secondary air 910. The flame stabilizer 926 is mounted at the end of the tubular burner nozzle 906 while the air separation cone 924 is installed on a cylindrical sleeve that separates the inner and outer secondary air zones 914 and 916.

The inner and outer zones 914 and 916 direct the secondary air radially outward by the combined action of the burner throat and the swirl imparted by the spin vanes 922, generating internal recirculation zones (IRZ) 930. FIG. 1 shows the predicted reverse flow IRZ streamlines for a low-NOx pulverized coal fired burner 900 having a conventional air separation cone 924. NOx is formed along the outer air-rich periphery of the flame as secondary air is introduced from the inner and outer air zones. The IRZ causes the NOx formed at the outer fringe of the flame to recirculate back along the fuel rich flame core, where hydrocarbon radicals react to reduce the NOx.

The size of the IRZ can be increased somewhat by imparting more swirl on the secondary air flow, and extending the flow deflection devices, or increasing their angle of attack. Generation of high swirling flows require fan power boosting due to higher pressure drop. High swirl combustion can also intensify the fuel/oxidizer mixing and generate high NOx emissions. Extension of flow deflecting devices (flame holder or air separation cone) into the furnace could expose those parts to high flame temperatures and cause damage. Increasing the angle of attack on the flow deflecting devices could restrict the air flow passages, raise the pressure drop, and diminish the swirl effects. Therefore, a device is needed for safely and effectively increasing the size of the IRZ, without damaging flow deflecting devices, causing increased NOx emissions, or raising pressure drop.

SUMMARY OF INVENTION

It is an object of the present invention to provide a device which safely and effectively increases the size of the IRZ, without damaging flow deflecting devices, causing increased NOx emissions, or raising pressure drop.

Accordingly, a large diameter mid-zone air separation cone is provided for increasing the IRZ and decreasing NOx. The air separation cone has a larger diameter than the conventional air separation cone. The mid-zone air separation cone has a short cylindrical leading edge that fits in the outer air zone of a burner. The mid-zone air separation cone is supported by standoffs inside the outer air zone. The mid-zone air separation cone splits the outer air zone secondary air flow into two equal or unequal streams depending on the position of the air separation cone with respect to the outer air zone, and deflects a portion of the secondary air flow radially outward. Since the radial position of the mid-zone air separation cone is farther from the burner centerline than the radial position of the conventional air separation cone, the size of the IRZ is expanded and NOx emissions are minimized.

The mid-zone air separation cone can be used with many types of burners. The mid-zone air separation cone can be used with burners fueled by pulverized coal, oil, or natural gas. The mid-zone air separation cone can be used with burners with primary air and coal in the center or a large central passage of secondary air surrounded by primary air and coal. The mid-zone air separation cone can essentially be used with any burner where there is at least one air zone surrounding a fuel delivery nozzle or annulus, where the air separation cone is of a large diameter and therefore the IRZ is enlarged.

Thus, some of the advantages of using the mid-zone air separation cone of the present invention are expansion of the IRZ, better flame stabilization and attachment, and lower NOx emissions. Also, there is no adverse effect on burner operation, such as damage to air separation cone or other components of the burner and pressure drop is not raised. The mid-zone air separation cone is a simple cost-effective solution that requires no additional conduits inside a burner and can be installed with relative ease inside the air zone of many burners.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
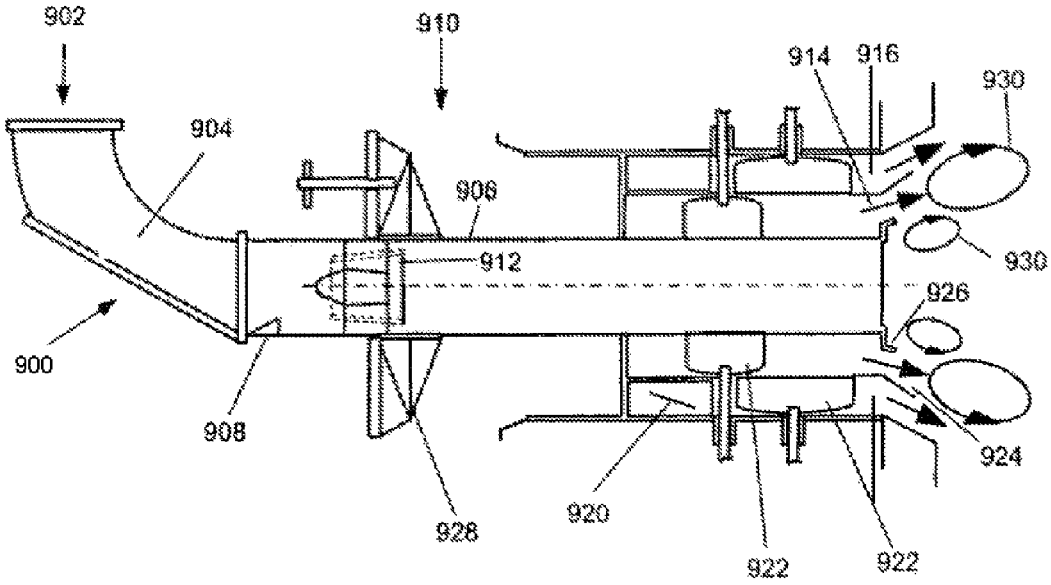
FIG. 1 is a schematic drawing showing the predicted reverse flow IRZ streamlines for a low-NOx pulverized coal fired burner having the conventional air separation cone.
Figure 2:
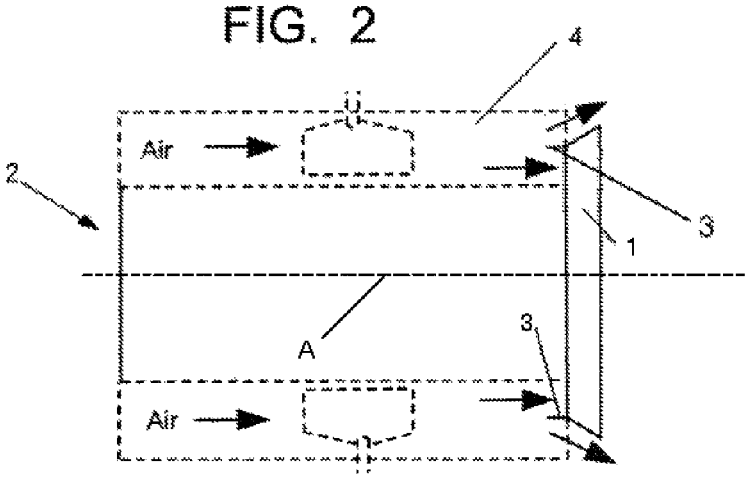
FIG. 2 is a schematic drawing of the mid-zone air separation cone of the present invention at the end of a burner.

Referring now to the drawings, in which like reference numerals are used to refer to the same or similar elements, FIG. 2 shows the end of a burner 2 which is adjacent or near a furnace. The end of the burner 2 includes a large diameter mid-zone air separation cone 1 with a short cylindrical leading edge 3 that fits in the middle of an outer secondary air zone 4. Additionally, as illustrated by FIGS. 2, 4, 5, 6 and 7, the leading edge 3 along its entire length is parallel to the horizontal axis A of the mid-zone separation cone. The device is supported by standoffs (not shown) inside the outer secondary air zone 4 and is not directly connected to any conduits in the burner. It essentially splits the outer air zone 4 secondary air flow into two streams and deflects a portion of the secondary air flow radially outward. Since the radial position of the air separation cone 1 is farther from the burner centerline than the radial position of the conventional air separation cone shown in FIG. 1, it expands the IRZ size and with that, the NOx emissions are minimized.

The diverging angle of the mid-zone air separation cone can be between 25 to 45° from the horizontal axis A (50 to 90° included angle). Although the embodiment in FIG. 2 shows that mid-zone air separation cone fits at approximately the middle of the outer air zone annulus, the cone may also be fitted anywhere within the outer air zone annulus to divide the secondary air stream in any desired proportion. The length of the cone 1 can vary depending on the air zone gap and burner size. The mid-zone air separation cone 1 can also be used in burners designed for firing pulverized coal, fuel oil, and natural gas.

Figure 3:
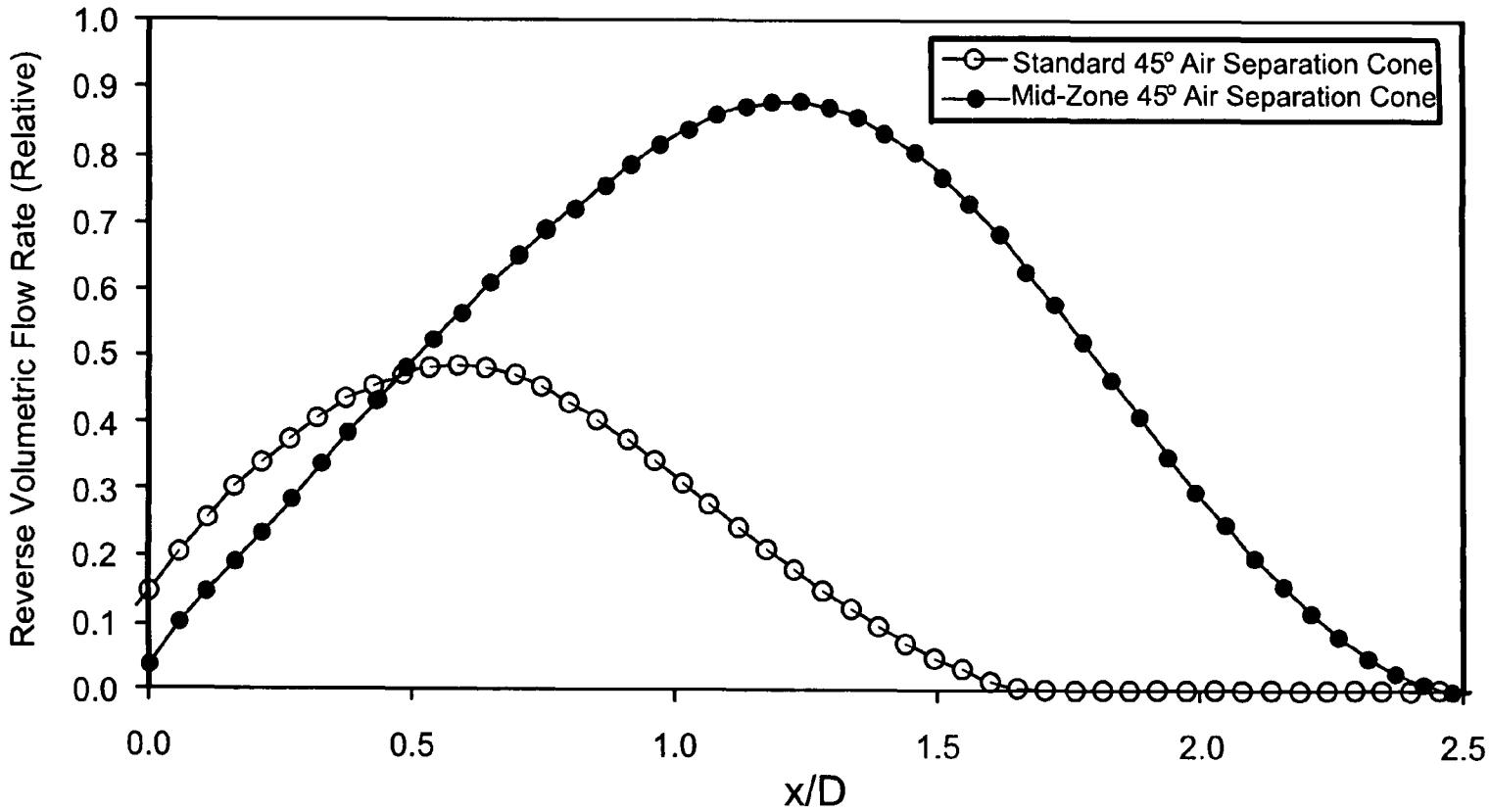
FIG. 3 is a graph plotting reverse volumetric flow rate versus axial distance for both a conventional air separation cone and the mid-zone air separation cone of the present invention.

FIG. 3 shows the computer modeling predictions of reverse (recirculating) flow rates in the near-burner region of the flame at different axial distances up to 2.5 burner diameters (x/D=2.5). The plots clearly indicate a larger IRZ (more reverse flow) for the case with the mid-zone air separation cone relative to conventional air separation cone. It is noted that the calculations correspond to staged combustion of an eastern bituminous coal at 0.85 burner stoichiometry.

FIGS. 4 through 7 show four possible installations of the mid-zone air separation cone 1 in four different types burners. Although four different embodiments of the invention are shown, the invention is not limited to these embodiments. The mid-zone air separation cone of the present invention can also be installed in other burners not shown here, where there is at least one air zone surrounding a fuel delivery nozzle or annulus.

Figure 4:
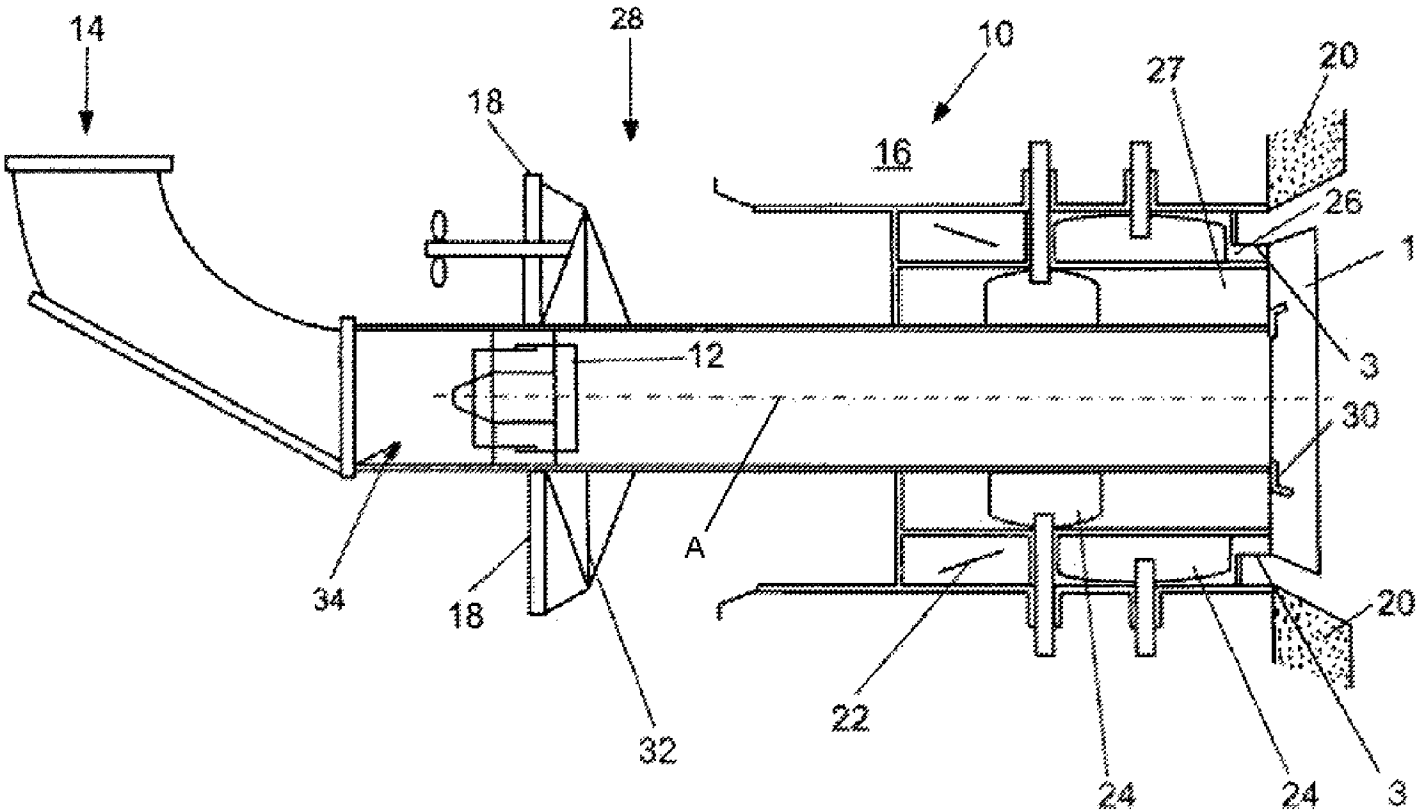
FIG. 4 is a schematic drawing of the low NOx DRB-XCL® pulverized coal burner incorporating the mid-zone air separation cone of the present invention.

FIG. 4 shows installation of the mid-zone air separation cone 1 in a low NOx DRB-XCL® pulverized coal burner 10, which is described in more detail as prior art (FIG. 2) in U.S. Pat. No. 5,829,369, which is incorporated by reference. The burner 10 includes a conical diffuser 12 and deflector 34 situated within the central conduit of the burner 10 which is supplied with pulverized coal and air by way of a fuel and primary air (transport air) inlet 14. A windbox 16 is defined between the inner and outer walls 18, 20 respectively. The windbox 16 contains the burner conduit which is concentrically surrounded by walls which contain an outer array of fixed spin vanes 22 and adjustable angle spin vanes 24 within an outer air zone 26. An inner air zone 27 is provided concentrically within the outer air zone 26. The burner 10 is provided with a flame stabilizer 30 and a slide damper 32 for controlling the amount of secondary air 28.

A mid-zone air separation cone 1 of the present invention is provided for increasing the IRZ zone and decreasing NOx. The air separation cone 1 has a larger diameter than the air separation cone shown in FIG. 1. The mid-zone air separation cone 1 also has a short cylindrical leading edge 3 that fits in the middle of the outer air zone 26. The mid-zone air separation cone 1 is supported by standoffs (not shown) inside the outer air zone 26. The mid-zone air separation cone 1 splits the outer air zone 26 secondary air flow into two streams and deflects a portion of the secondary air flow radially outward. Since the radial position of the air separation cone 1 is farther from the burner centerline than the conventional air separation cone shown in FIG. 1, it expands the IRZ size and accordingly, NOx emissions are minimized.

Figure 5:
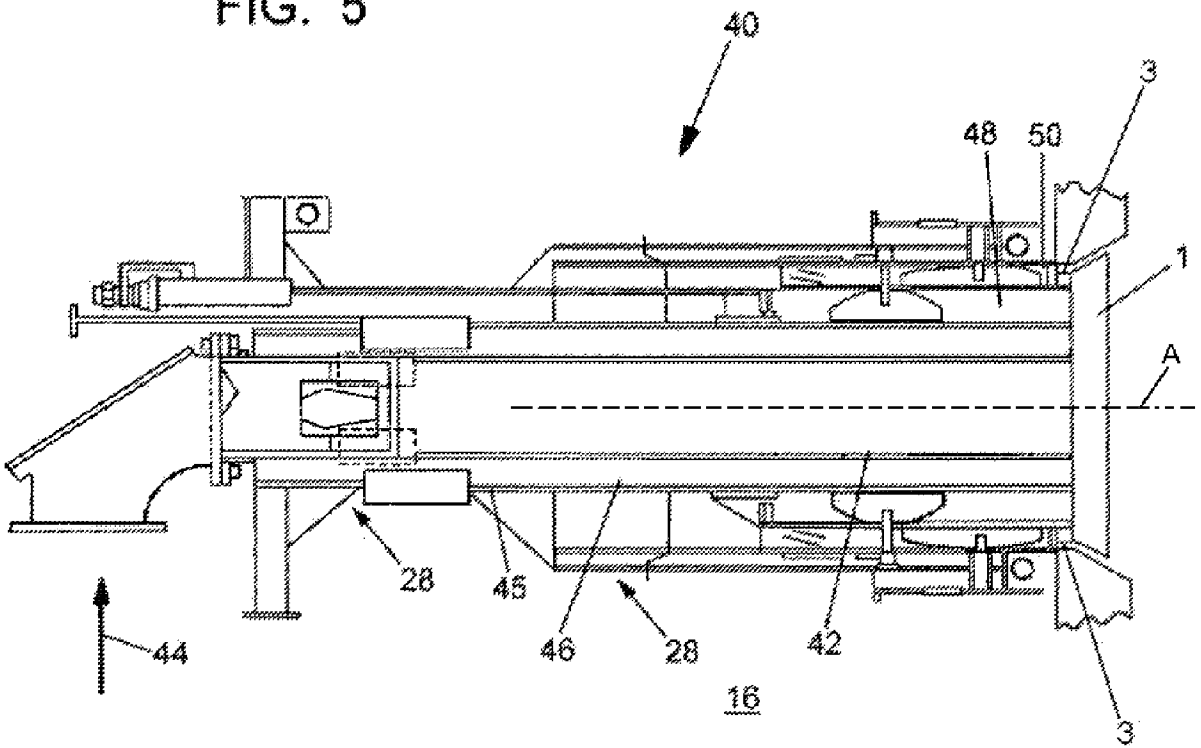
FIG. 5 is a schematic drawing of the low NOx DRB-4® burner incorporating the mid-zone air separation cone of the present invention.

FIG. 5 shows a burner generally depicted 40 in accordance with then present invention. Burner 40, which is also referred to as the DRB-4Z® burner, comprises a series of zones created by concentrically surrounding walls in the burner conduit which deliver a fuel such as pulverized coal with a limited stream of transport air (primary air), and additional combustion air (secondary air) 28 provided from the burner windbox 16. The central zone 42 of the burner 40 is a circular cross-section primary zone, or fuel nozzle, that delivers the primary air and pulverized coal by way of inlet 44 from a supply (not shown). Surrounding the central or primary zone 42 is an annular concentric wall 45 that forms the primary-secondary transition zone 46 which is constructed either to introduce secondary combustion air or to divert secondary air to the remaining outer air zones. The transition zone 46 acts as a buffer between the primary and secondary streams to provide improved control of near-burner mixing and flame stability. The transition zone 46 is configured to introduce air with or without swirl, or to enhance turbulence levels to improve combustion control. The remaining annular zones of burner 40 consist of the second inner air zone 48 and the outer air zone 50 formed by concentrically surrounding walls which deliver the majority of the combustion air.

The burner 40 includes a mid-zone air separation cone 1 having a short cylindrical leading edge 3 that fits in the middle of the outer air zone 50. The mid-zone air separation cone 1 is supported by standoffs (not shown) inside the outer secondary air zone annulus. The mid-zone air separation cone 1 splits the outer air zone 50 secondary air flow into two streams and deflects a portion of the secondary air flow radially outward. Since the radial position of the air separation cone 1 is farther from the burner centerline than the conventional air separation cone shown in FIG. 1, it expands the IRZ size and accordingly, NOx emissions are minimized.

Structurally, the design of the burner 40 (DRB-4Z®) according to the present invention is based largely on that for the DRB-XCL® burner shown in FIG. 4. A detailed explanation of the differences between the two types of burners is provided in U.S. Pat. No. 5,829,369.

Figure 6:
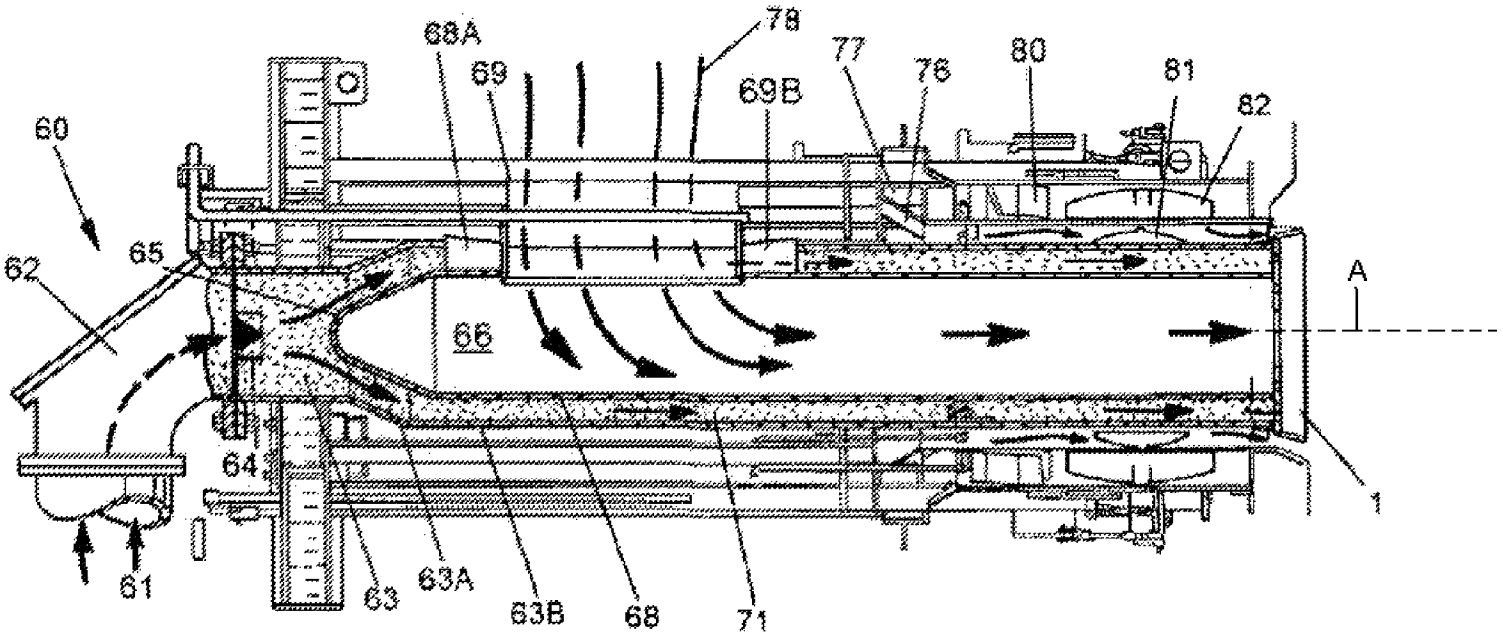
FIG. 6 is a schematic drawing of the low NOx central air jet pulverized coal burner incorporating the mid-zone air separation cone of the present invention.

FIG. 6 shows a low NOx central air jet pulverized coal burner 60 in which pulverized coal and primary air (PA/PC) 61 enter at an inlet and pass through a burner elbow 62. The pulverized coal mostly travels along the outer radius of the elbow 62 and concentrates into a stream along the outer radius at the elbow exit. The pulverized coal enters a coal pipe 63 and encounters a deflector 64 which redirects the coal stream into a conical member 65, dispersing the coal. A core or central pipe 66 is attached to the downstream side of conical member 65. The coal pipe 63 expands in section 63A to form a larger diameter section 63B. The dispersed coal travels into an annulus 71 formed between central pipe 66 and the coal pipe 63A and then 63B. The PA/PC 61 then exits the coal annulus 71 into the burner throat 68, and then out into the furnace (not shown). The core or central pipe 66 and the annulus 71 form a fuel nozzle.

Secondary air 78 is supplied by forced draft fans or the like, preheated in air heaters, and supplied under pressure. Feeder duct 69 supplies core air to central zone 66. Wedged shaped pieces 68A and 69B provide a more contoured flow path for the PAIPC 61 as it travels past the core air supply feeder duct 69. The core air proceeds down central zone 66 until it exits. Some secondary air flows into transition zone 76 or outer air zone 77. Secondary air can be throttled to one zone or the other, or to supply lesser quantities of air to both zones to cool the burner when the burner is out of service. The transition zone 76 is separated from the outer air zone 77. The transition zone 76 is constructed to provide air for near-burner mixing and stability. Adjustable angle spin vanes 81 are situated in the transition zone 76 to provide swirl to transition air. Outer air proceeds through fixed spin vanes 80 and adjustable angle spin vanes 82 which impart swirl to the outer air.

A large diameter mid-zone air separation cone 1 with a short cylindrical leading edge 3 (not shown in FIG. 6) fits in the middle of the outer air zone 77. The cone 1 is supported by standoffs (not shown) inside the outer air zone 77 and is not directly connected to any conduits in the burner. The cone 1 splits the outer air zone 77 secondary air flow into two streams and deflects a portion of the secondary air flow radially outward. Since the radial position of the air separation cone 1 is farther from the burner centerline than the conventional air separation cone shown in FIG. 1, it expands the IRZ size and with that, the NOx emissions are minimized.

Performance of the mid-zone air separation cone was further tested with low NOx central air jet pulverized coal burner at 100 million Btu/hr while firing a pulverized eastern bituminous coal. At 17% overall excess air level, and 0.80 burner stoichiometry, NOx emissions were 0.276 lb/million Btu with the conventional air separation cone installed on the end of the cylindrical sleeve 5 separating the transition zone 76 from outer air zone 77, and 0.238 lb/million Btu with the mid-zone air separation cone, shown in FIG. 6, while maintaining low CO and unburned carbon levels.

Figure 7:
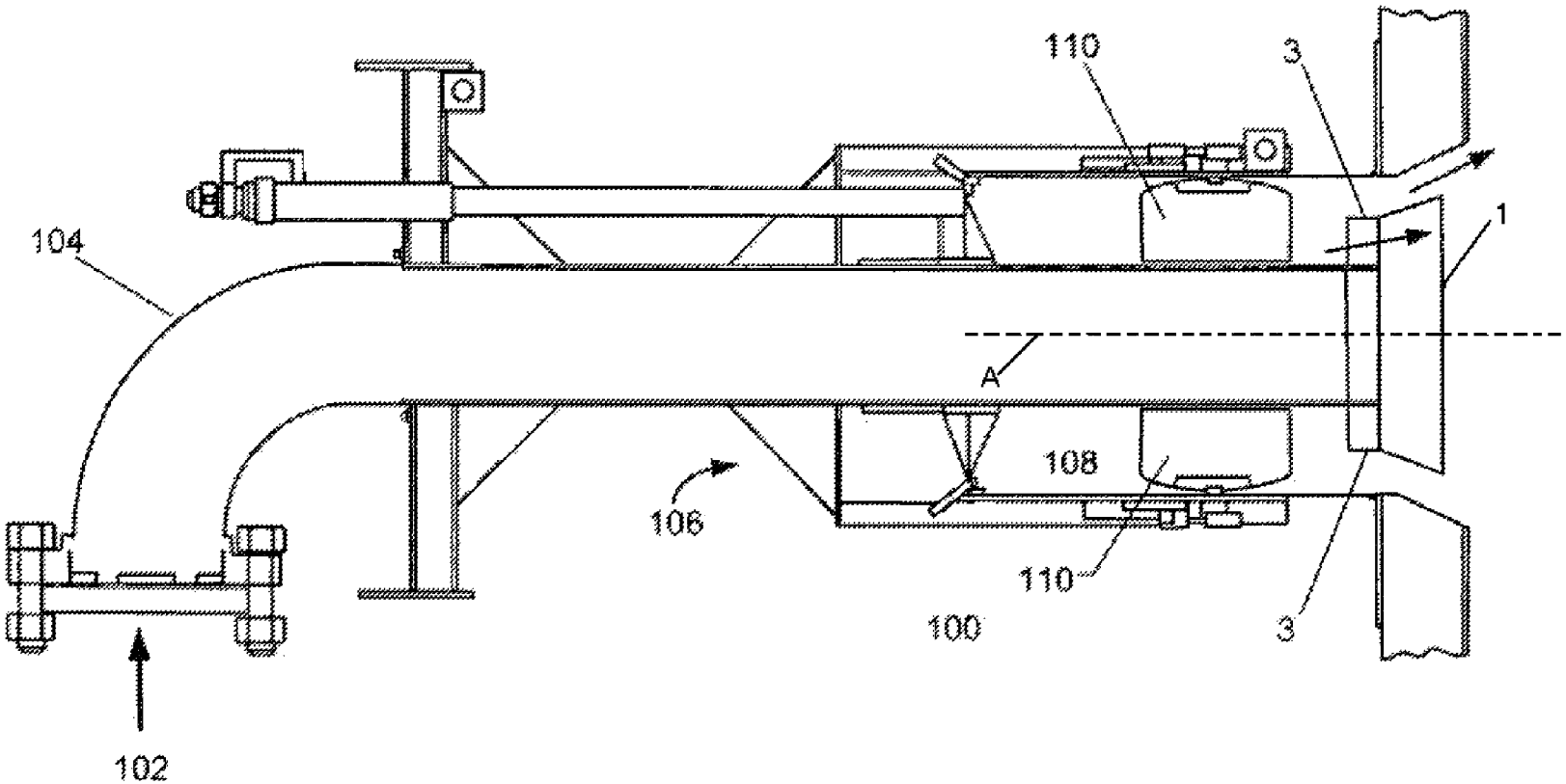
FIG. 7 is a schematic drawing of the low NOx XCL-S pulverized coal burner incorporating the mid-zone air separator cone of the present invention.

FIG. 7 show another low NOx burner embodiment according to the present invention. A fossil fuel, such as pulverized coal, and primary air enter burner 100 via burner inlet 102, and pass through burner elbow 104. Secondary air 106 is provided to outer air zone 108, wherein swirl may be added via adjustable vanes 110.

Mid-zone air separation cone 1 having a short cylindrical leading edge 3 is provided within outer air zone 108. Air separation cone 1 is supported by standoffs (not shown) inside the outer air zone 108. Air separation cone 1 splits the outer air zone 108 secondary air flow into two streams and deflects a portion of the secondary air flow radially outward. Since the radial position of the air separation cone 1 is farther from the burner centerline than the conventional air separation cone shown in FIG. 1, it expands the IRZ size and provided a means for minimizing NOx emissions.

While a specific embodiment of the invention has been shown and described in detail to illustrate the application of the principles of the invention, it will be understood that the invention may be embodied otherwise without departing from such principles.

What is claimed is:

1. A burner with low emissions and low unburned fuel losses, comprising:

a fuel nozzle means with an axis and an outlet;

at least one inner air zone with an outlet end concentrically surrounding said fuel nozzle means;

an outer air zone with an outlet end having a wall concentrically surrounding said inner air zone;

first means for imparting swirl positioned in said inner air zone;

second means for imparting swirl positioned in said outer air zone; and an air separation cone for splitting secondary air flow in said outer air zone into two separate streams and deflecting a portion of said secondary air flow radially outward, wherein said imparted swirl produces internal recirculation zones, said air separation cone having a horizontal axis;

wherein said air separation cone includes a cylindrical leading edge that fits in said outer air zone, said cylindrical leading edge being completely parallel to said horizontal axis of said air separation cone, and wherein a diverging angle of said air separation cone with respect to said axis of said fuel nozzle means ranges from 25 to 45 degrees;

wherein said at least one inner air zone comprises:

a first annular transition zone concentrically surrounding said fuel nozzle means, said first annular transition zone being constructed to provide air for near-burner mixing and stability; and wherein said fuel nozzle means includes a center passage for secondary air and a surrounding outer passage for primary fuel with primary air for combustion in a primary zone;

wherein said at least one inner air zone is an annular transition zone concentrically surrounding said fuel nozzle means, said annular transition zone being constructed to provide air for near-burner mixing and stability;

wherein said air separation cone is supported by standoffs inside said outer air zone; and wherein said air separation cone divides said outlet end of said outer air zone into two outlets.

2. A burner according to claim 1, wherein said air separation cone is positioned to split said secondary flow into equal portions.

3. A burner according to claim 1, wherein said air separation cone is positioned to split said secondary flow into unequal portions.

4. A low emissions burner, comprising: a fuel nozzle means for passage of at least a primary fuel with primary air for combustion in a primary zone, said fuel nozzle means having an axis and further having an outlet end;

at least one inner air zone with an outlet end concentrically surrounding said fuel nozzle means;

an outer air zone with an outlet end having a wall concentrically surrounding said at least one inner air zone defining means;

first means for imparting swirl positioned in said inner air zone;

second means for imparting swirl positioned in said outer air zone; and a mid-zone air separation cone fitted within said outer air zone and having a horizontal axis;

wherein said air separation cone includes a cylindrical leading edge that fits in said outer air zone, said cylindrical leading edge being completely parallel to said horizontal axis of said air separation cone, and wherein a diverging angle of said air separation cone with respect to said axis of said fuel nozzle means ranges from 25 to 45 degrees; and wherein said at least one inner air zone comprises:

a first annular transition zone concentrically surrounding said fuel nozzle means, said first annular transition zone being constructed to provide air for near-burner mixing and stability; and wherein said fuel nozzle means includes a center passage for secondary air and a surrounding outer passage for primary fuel with primary air for combustion in a primary zone;

wherein said at least one inner air zone is an annular transition zone concentrically surrounding said fuel nozzle means, said annular transition zone being constructed to provide air for near-burner mixing and stability;

wherein said air separation cone is supported by standoffs inside said outer air zone; and wherein said air separation cone divides said outlet end of said outer air zone into two outlets.

5. A burner according to claim 4, wherein said at least one inner air zone is an annular transition zone concentrically surrounding said fuel nozzle means, said annular transition zone being constructed to provide air for near-burner mixing and stability.

6. A burner according to claim 4, wherein said air separation cone is positioned to split secondary air flow into equal portions.

7. A burner according to claim 4, wherein said air separation cone is positioned to split secondary air flow into unequal portions.

8. A burner according to claim 4, wherein said fuel nozzle means includes a center passage for secondary air and a surrounding outer passage for primary fuel with primary air for combustion in a primary zone.

9. A burner with low emissions and low unburned fuel losses, comprising:

a fuel nozzle means with an axis and an outlet;

at least one inner air zone with an outlet end concentrically surrounding said fuel nozzle means;

an outer air zone with an outlet end concentrically surrounding said fuel nozzle;

means for imparting swirl positioned in said outer air zone; and an air separation cone for splitting secondary air flow in said outer air zone into two separate streams and deflecting a portion of said secondary air flow radially outward, wherein said imparted swirl produces internal recirculation zones, said air separation having a horizontal axis;

wherein said air separation cone includes a cylindrical leading edge that fits in said outer air zone, said cylindrical leading edge being completely parallel to said horizontal axis of said air separation cone, and wherein a diverging angle of said air separation cone with respect to said axis of said fuel nozzle means ranges from 25 to 45 degrees; and wherein said at least one inner air zone comprises:

a first annular transition zone concentrically surrounding said fuel nozzle means, said first annular transition zone being constructed to provide air for near-burner mixing and stability; and wherein said fuel nozzle means includes a center passage for secondary air and a surrounding outer passage for primary fuel with primary air for combustion in a primary zone;

wherein said at least one inner air zone is an annular transition zone concentrically surrounding said fuel nozzle means, said annular transition zone being constructed to provide air for near-burner mixing and stability;

wherein said air separation cone is supported by standoffs inside said outer air zone; and wherein said air separation cone divides said outlet end of said outer air zone into two outlets.

10. A burner according to claim 9, wherein said air separation cone is positioned to split said secondary flow into equal portions.

11. A burner according to claim 9, wherein said air separation cone is positioned to split said secondary flow into unequal portions.

12. The low emissions burner according to claim 4, wherein said mid-zone air separation cone is supported by standoffs inside said outer air zone.

* * * * *